US008469798B2

(12) United States Patent
Harari

(10) Patent No.: US 8,469,798 B2
(45) Date of Patent: Jun. 25, 2013

(54) METHOD AND SYSTEM FOR CONVERTING LANDBASED PLAYERS TO ON-LINE PLAYERS

(75) Inventor: Sagi Harari, Isle of Man (GB)

(73) Assignee: Videob Holdings Limited, Douglas (IM)

( * ) Notice: Subject to any disclaimer, the term of this patent is extended or adjusted under 35 U.S.C. 154(b) by 413 days.

(21) Appl. No.: 12/765,417

(22) Filed: Apr. 22, 2010

(65) Prior Publication Data

US 2010/0203956 A1 Aug. 12, 2010

Related U.S. Application Data

(63) Continuation of application No. PCT/IB2007/054288, filed on Oct. 22, 2007.

(51) Int. Cl.
*A63F 9/24* (2006.01)

(52) U.S. Cl.
USPC ..... 463/25

(58) Field of Classification Search
USPC ..... 463/25
See application file for complete search history.

(56) References Cited

U.S. PATENT DOCUMENTS 5,265,874 A * 11/1993 Dickinson et al. ..... 463/25
6,852,031 B1 2/2005 Rowe
6,905,411 B2 6/2005 Nguyen et al.
2003/0171149 A1* 9/2003 Rothschild ..... 463/42
2003/0190959 A1* 10/2003 Olson ..... 463/42
2005/0193209 A1* 9/2005 Saunders et al. ..... 713/182
2009/0170596 A1* 7/2009 Gagner et al. ..... 463/25

OTHER PUBLICATIONS

International Search Report dated Aug. 27, 2008 in International Patent Application No. PCT/IB07/54288.
Written Opinion of the International Searching Authority dated Aug. 27, 2008 in International Patent Application No. PCT/IB07/54288.

* cited by examiner

*Primary Examiner* — Corbett B Coburn
(74) *Attorney, Agent, or Firm* — Oliff & Berridge, PLC

(57) ABSTRACT

There is provided a computerized gaming system operable in a landbased gaming mode controlled by a landbased gaming control unit and in an on-line gaming mode controlled by an on-line gaming control unit operating independently of the landbased gaming control unit, and a method of operating thereof. The method comprises obtaining by the landbased gaming control unit an information related to a player, the information indicative, at least, of said player's balance with regard to the landbased gaming mode. The method further comprises, responsive to the player's switching from the landbased gaming mode to on-line gaming mode, electronically communicating the most updated information indicative, at least, of said player's balance with regard to the landbased gaming mode from the landbased control unit to the on-line control unit controlling the on-line gaming mode, thereby enabling said player to participate in the on-line playing mode.

13 Claims, 3 Drawing Sheets

METHOD AND SYSTEM FOR CONVERTING LANDBASED PLAYERS TO ON-LINE PLAYERS

TECHNICAL FIELD

The present invention generally relates to the field of gaming machines and more particularly to a method and system for encouraging players playing with landbased devices to play online games.

BACKGROUND

Gaming devices comprise both landbased gaming machines and on-line gaming applications.

On a landbased gaming machine a player typically buys credit in a vending point such as a kiosk or automatic vending machine that accepts coins or bills and provides a magnetic ticket. In case that the player wins a certain amount of money he will cash the money by handing in a ticket or an equivalent kind of the winning proof.

In the on-line gaming application the process usually requires on-line purchasing of credit to start the game, and when a player wins a certain amount of money his account will be credited accordingly or he will be credited by using other credit means.

The term on-line gaming applications or on-line gaming session in this description refers to applications wherein a players connects directly to a gaming session such as connecting through the internet (I/T) via a personal computer (PC), mobile phone, personal digital assistant (PDA) etc. This is to be distinguished from landbased gaming machines where optionally a player may play on a gaming server based machine or other type of device that may also be connected to a network such as the (I/T).

While the landbased gaming machines and on-line gaming applications are substantially similar, there is a significant difference in the readiness of people to participate in the two types of gaming sessions.

The main cause for people being reluctant to participate in on-line gaming sessions is the hesitation of many people from disclosing their credit card details over the Internet. However, usually after a first experience with a certain on-line vendor this primary hesitation dissolves.

Thus, the transition of a client from a physical vendor to a first on-line experience constitutes a significant bottleneck.

There is therefore a need to attract participants of land based gaining machines to get a primary experience with on-line gaming applications.

SUMMARY

An aspect of an embodiment of the disclosure relates to a method and system for converting a prize won by a landbased gaming machine, or a remaining credit from a landbased machine to credit for on-line gaming machines.

In accordance with a preferred embodiment of the present method, there is provided a method of converting a landbased gaining machine prize to on-line gaming environment credit comprising one or more of the following steps: receiving a landbased gaming wining document from a player; determining at least one alternative for converting at least a part of the land based wining document to an on-line gaming credit, valid for use in an on-line gaming application of at least one on-line gaining provider; receiving an accepted offer from the player for the at least one alternative; providing the player with at least one credit indication according to said accepted offer; and updating the on-line gaining provider with the accepted offer.

In some exemplary embodiments of the method, the method also comprises a step of memorizing the player's details and the accepted offer.

In some exemplary embodiments of the method, the method also comprises a step of preliminary check to verify that the player is eligible for getting an alternative for converting at least a part of the land based wining document to an on-line gaming credit.

In some exemplary embodiments of the method, the method also comprises a step of transferring details from an operator of the landbased gaming machine to an operator of the on-line gaming environment, or form an operator of the on-line gaining environment to the operator of the landbased gaming machine. The details may comprise player details or available funds.

In some exemplary embodiments of the method, check to verify that the player is eligible for getting an alternative for converting at least a part of the land based wining document to an on-line gaining credit consists of checking the player's age.

In some exemplary embodiments of the method, check to verify that the player is eligible for getting an alternative for converting at least a part of the land based wining document to an on-line gaming credit consists of considering the player's history records.

In some exemplary embodiments of the method, determining the at least one alternative depends on a commercial condition set by at least one on-line gaming provider.

In some exemplary embodiments of the method, the credit indication comprises a username and password to be used on-line in an on-line gaming site.

In some exemplary embodiments of the method, the credit indication comprises an alphanumeric code to be used on-line in an on-line gaming site.

In some exemplary embodiments of the method, the method further comprises a step of offering the player that uses the credit indication to play on-line gaming to buy credit for gaming sessions on-line.

In some exemplary embodiments of the method, the method further comprises a step of enabling the player that used his on-line credit and completed an on-line gaming session with positive balance to use the positive balance for playing on landbased gaming machines.

1. It is further an object of the present invention to provide a system for converting land based gaming machine prize or a landbased gaming machine positive balance to an on-line gaming environment credit the system comprising: one or more landbased gaming machine; means for receiving a winning document that is provided by the land based gaming machine; one or more on line gaming providers; means for determining at least one alternative for converting at least part of said landbased wining document to an on-line gaming credit valid for use in an on-line gaming application of said at least one on-line gaming provider; means for receiving an accepted offer from the player for at least one alternative; and means fox updating said at least one on-line gaming provider according to said player's accepted offer. Within the system, the component for updating is optionally a software component comprising an application program interface for an on-line gaming server or an application program interface for a land based gaming operator.

BRIEF DESCRIPTION OF THE DRAWINGS

The present invention will be understood and appreciated more fully from the following detailed description taken in conjunction with the drawings. Identical structures, elements or parts, which appear in more than one figure, are generally labeled with a same or similar number in all the figures in which they appear, wherein.

DETAILED DESCRIPTION

Figure 1:
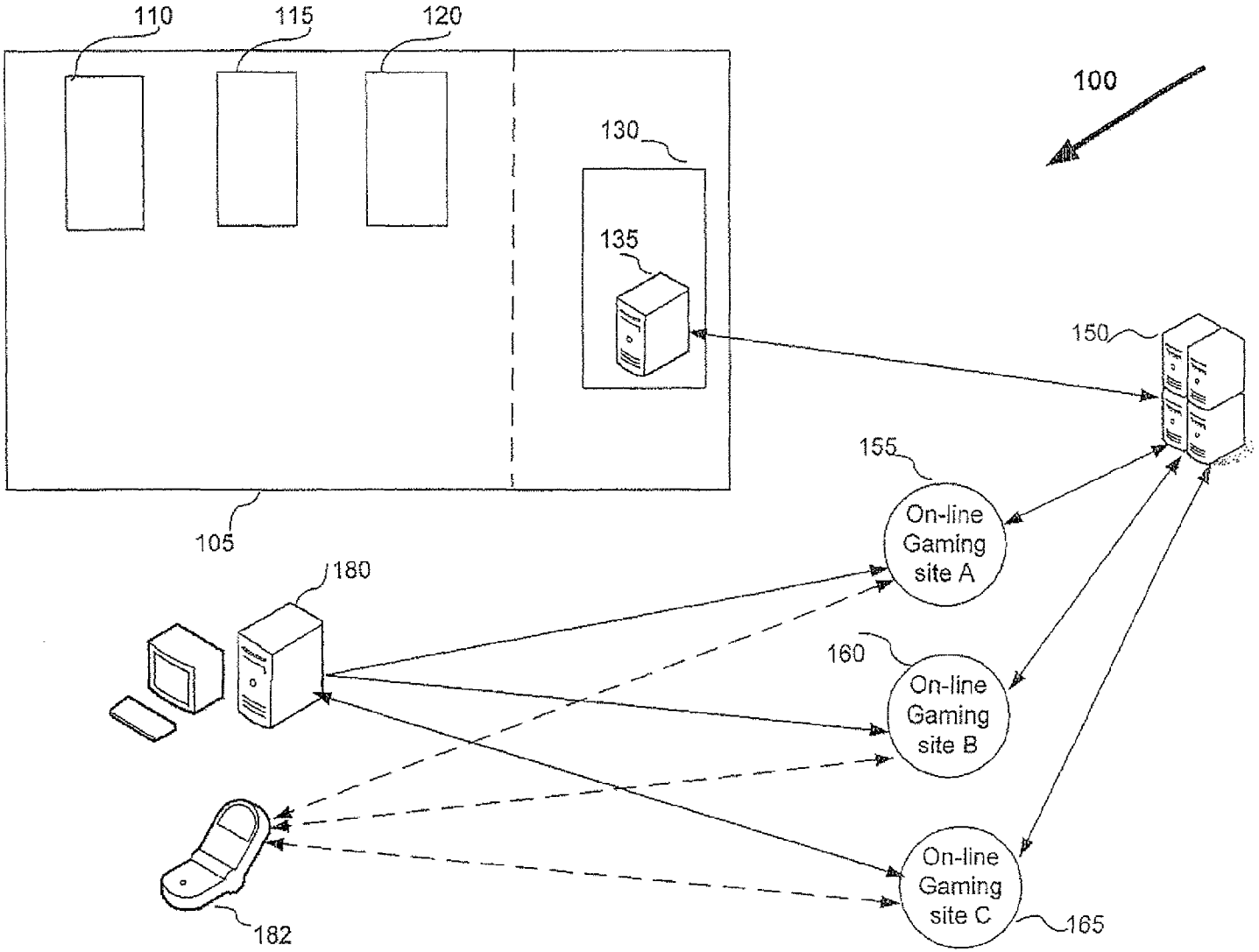
FIG. 1 is a schematic illustration of a system that enables the conversion of land based gaming machine coupons to on-line gaming credit, according to an exemplary embodiment of the apparatus.

FIG. 1 shows a schematic illustration of a system 100 including a land based gaining machines site 105, a gaming server 150, three gaming web sites 155, 160, 165 a cellular phone 182 and a home PC 180.

A gaming machine is generally a commercially available terminal, such as Deluxe manufactured by SmartGames of Russia, or Nevada manufactured by Tab Austria. The terminal comprises a memory and CPU (not shown) for running one or more applications, such as Black Jack game.

A player may choose a gaming machine among gaming machines 110, 115, or 120. It should be noted that the gaming machines may also include any kind of on-line environment that enables to participate in on-line gaming applications. In case that the player wins a prize, typically an amount of money (referred to as "winning amount"), he will get a coupon or any other output, such as magnetic card or alphanumeric code (referred to as "winning document") from any of the gaming machines 110, 115 or 120 to certify his right to get a prize or money. Alternatively the player may not use all his credit and then he will get a coupon or any other output to indicate his positive balance, such as magnetic card or alphanumeric code (referred to as "balance indication"). The player optionally may get both a balance indication and a winning document Having gotten the wining document, or the balance indication the player goes to a kiosk 130 where he presents the winning document/balance indication, either to a person in charge or to any kind of automatic device.

In case that the player represents a balance indication, the kiosk, either human I/F or an automat optionally replaces the balance indication with online credit for future use by the player. The online credit provided to the player may be at the same amount that was indicated in the balance indication or optionally higher in order to provide the player with incentive to experience online gaming sessions. The player will get a proof for the amount of credit that he is entitled to (referred to as credit indication or "credit document"). It should be noted that the credit indication could be implemented in many ways such as an alphanumeric code, a pair of username and password, a CD with a chunk of code etc.

In an exemplary embodiment according to the invention, the player represents a wining indication. Preferably, the details of the wining event are communicated to a client device 135 and transmitted to a gaming server 150 that determines a few alternatives for providing reward to the player. The gaming server may be any kind of gaming server that typically has a CPU, memory, I/O and I/F for connecting to remote clients. The connection between the client device 135 and the gaming server 150 can be of any commercially known communication infrastructure such as Internet, intranet etc. The alternatives are based on providing the player with credit (referred to as "on-line credit") to be used by the player for playing an on-line based gaming.

Upon completing the process of determining alternatives for providing reward to the player, the player gets an offer either to cash exactly the winning amount as indicated or associated with the wining document, or to choose one of the alternatives presented to him. For example, the system will suggest the player to get half the amount of the wining amount in cash and convert half the other half of the winning amount to 80% of the wining amount in credit for future use for playing on-line games associated with the same operator of the gaming machines.

In an exemplary embodiment of the invention, an operator of gaming terminals and online gaming sites may suggest to a player a multiplicity of conversion rates between gaming winning sums and on-line credit amounts, and different percentage of the wining sum to which this conversion can apply, depending on the operators of the gaming sites. Thus, various on-line gaming providers may suggest different percentage and different conversion rates. For example a player that won a hundred (100) dollar or completed a landbased machine session with a positive balance of a hundred (100) dollar, may get offers such as:

a. Get 50 dollars cash and 80 dollars credit for use in the on-line gaming site operated by "Great Gaming".
b. Get 60 dollars cash and 75 dollars credit for use the an on-line gaming site operated by "Computer Gaming".
c. Get 55 dollars cash, 40 dollars credit for use in the on-line gaming site operated by "Great Gaming", and 35 dollars credit for use in the gaming site operated by "Computer Gaming".

In an exemplary embodiment of the invention the alternatives determined by the system depend on the commercial conditions set by various on-line gaming providers. Thus, on-line gaming providers that suggest higher commission rates to the system operator will enjoy higher priority when determining alternatives.

After the player provides his response, i.e. accepts one of the offers, the decision is sent to gaming server 150 that will further connect to on-line gaming providers 155, 160 and 165, preferably via a dedicated Application Program Interface (API) layer, according to the player's choice. In another exemplary embodiment of the invention client 130 is replaced with a gaming server that performs the interface with the player, the determination of alternatives and communication with the on-line gaming sites 155, 160 and 165. After the player provides his selection he will get both the amount of cash money according to his choice and/or a proof for the amount of credit that he is entitled to, according to his choice (credit indication). It should be noted that the credit indication could be implemented in many ways such as an alphanumeric code, a pair of username and password, a CD with a chunk of code etc.

At a later stage, the player is using a computing platform such as a PC 180 or a mobile phone 180. The computing platform may be of various types such as a personal computer, a mainframe computer, or any other type of computing platform that is provisioned with a memory device (not shown), a CPU or microprocessor device, and several I/O ports (not shown), also cellular phones with computing abilities, PDAs or the like. The computing platform executes computer applications, comprising instructions arranged in modules, libraries or other components which interact to perform the methods or steps of the invention. The computer applications can be developed in any programming language, such as C, C++, C#, Java, VB, VB.Net or the like, and under any development environment, such as .Net, J2EE or others.

It will be appreciated that the components described above, can be implemented as detailed as one or more applications executed on a general purpose processor, or alternatively as firmware ported for a specific processor such as digital signal processor (DSP) or microcontrollers, or can be implemented as hardware or configurable hardware such as field programmable gate array (FPGA) or application specific integrated circuit (ASIC).

The player connects to one or more of the on-line gaming sites 155, 160, 165 and starts to play there. Upon login to any of the on-line gaming sites the player will be asked to provide data from the credit indication that will enable him to use the credit according to the accepted offer.

The process of updating the system (casino or gaming provider) with the player's credit can be performed already by the cashier at the time that the player gets the credit indication (or by an automatic vending machine that is programmed to perform the process that was previously described) or optionally later when the player logs in the on-line gaming session and at the time that he provides a code (password, key etc) his on-line credit is updated.

Figure 2A:
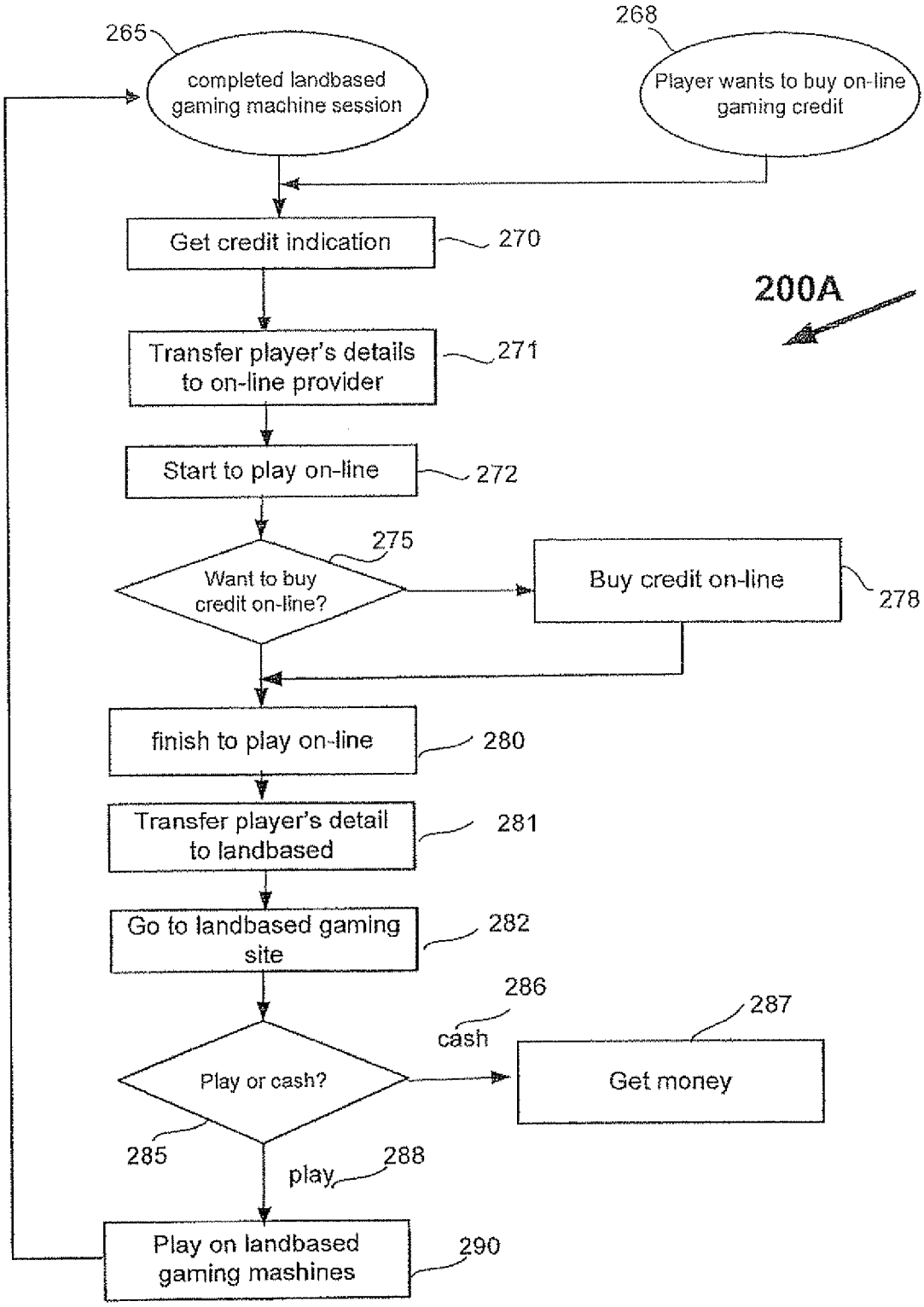
FIG. 2A is a flow chart illustrating the steps of a player that completed a gaming session on landbased gaming machine, proceeding to on-line gaming session and returning to landbased gaming site.

FIG. 2A shows a flow chart, generally referenced 200A illustrating the steps of a player that completed a gaming session on landbased gaming machine, proceeding to on-line gaming session and returning to landbased gaming site.

The flow starts when a player completed a gaming session on a landbased gaming machine (265) or when a player wants to buy credit for on-line gaming sessions (268). In an exemplary embodiment according to the invention, the player may buy credit for on-line gaming sessions from the cashier or from an automatic vending machine. This feature is critical for many potential players that do not trust the on-line payment procedures and will only participate in on-line gaming session if it will be possible to buy credit through a human or physical I/F.

The player gets a credit indication (270) that enables him to start to play on-line (272). On step 271 the player's details, including for example identification details, funds, balance, credit or the like are transferred from the gaming server to one or more sites or providers such as 155. The transfer is performed by a dedicated component such as a software component. The component takes care of secured funds and player details transfer between the landbased game server and an online game server. The transfer is bi-directional, since the funds and details are first transferred from the landbased server to the online server, and when the player has finished, the funds and details are transferred in the other way. Alternatively, the funds can be first transferred from the online server to the landbased server and back. The component preferably includes one or more Application Program Interface (API) layers. An online operator interface enables online server operators to communicate with landbased operators, and a landbased interface enables a landbased operator to communicate with online server operators and exchange details securely. It will be appreciated that the funds themselves can be kept and controlled by either the online game operator or the landbased game operator.

A player that gets a credit indication at the landbased gaming site may choose to become either a new Full Regular Online (FRO) player, i.e. once the player gets the credit indication he may perform all money transactions online, including being debited and credited in his online account, or alternatively the player may choose to be defined as Cash Only Account (COA) i.e. the player may only play online but either buying additional credit or cashing positive balances are performed only in a physical site and not online.

In an exemplary embodiment according to the invention, once the player logged in to the on-line application gaming session the system can offer the player any kind of offers that it may offer to a regular on-line player (referred to as "offers"), such as buying credit for gaming sessions on-line via credit card or other on-line credit dealers such as "moneybookers" and "pay-pal" (275). If the player accepts the offer he opens a new FRO account (278). In an exemplary embodiment according to the invention, the player completes the on-line gaming session with a positive credit balance (280). When the player finished playing, on step 281 the identification details, funds and other details are transferred back to the landbased gaming server, preferably via the same component described in association with step 271 above.

The player may later go to a landbased gaming machines site (282) where he will be asked if he wants either to cash his positive credit balance or use it for playing on the landbased gaming machines (285). It should be noted that the player may get any type of identification document such as user-id and password in order to enable the cashier/automatic vending machine to identify him and approve the player's positive balance. If the player chooses to cash the money (286) he will get the money as indicated on his identification document (287). If the player chooses to use it's positive credit for playing on the landbased gaming machines (288) he will proceed to play on the landbased gaming machines (290). In case that he completes the gaming session with a positive amount he returns to the starting position (265).

It should be noted that once a player is defined in the gaming system by his user-id and password (or equivalent means generally referred as player identification data), the user may continue to use the same player identification data for multiple gaming sessions, optionally as long as he plays at the same gaming system.

Thus, the system according to an exemplary embodiment of the invention enables the player, by using electronic funds and data transfer, to switch freely between the landbased machines and on-line gaming applications (referred to as "gaming modes"). Enabling the player to participate and easily switch between landbased gaming machines and on-line gaming sessions is clearly increasing the income expectancy of the system operator.

The ability to switch between landbased machines and on-line gaming applications (in both directions, i.e. from landbased machines to on-line gaming applications or from on-line gaming applications to landbased machines) is supported by an updating mechanism to ensure that at each point in time when a player switches between gaining modes, from a first gaming mode to a second gaming mode, the information about the player's credit is electronically communicated to a control unit (typically a server) that controls the second gaming mode (either landbased machine or on-line gaining application).

For example, the system that is shown in FIG. 1 includes a gaming server 150 that is updated by the client device 135 when the player finishes a session on the landbased machines, or by a communication device (not shown) that is located in each one of the on-line gaming providers 155, 160, 165.

Figure 2B:
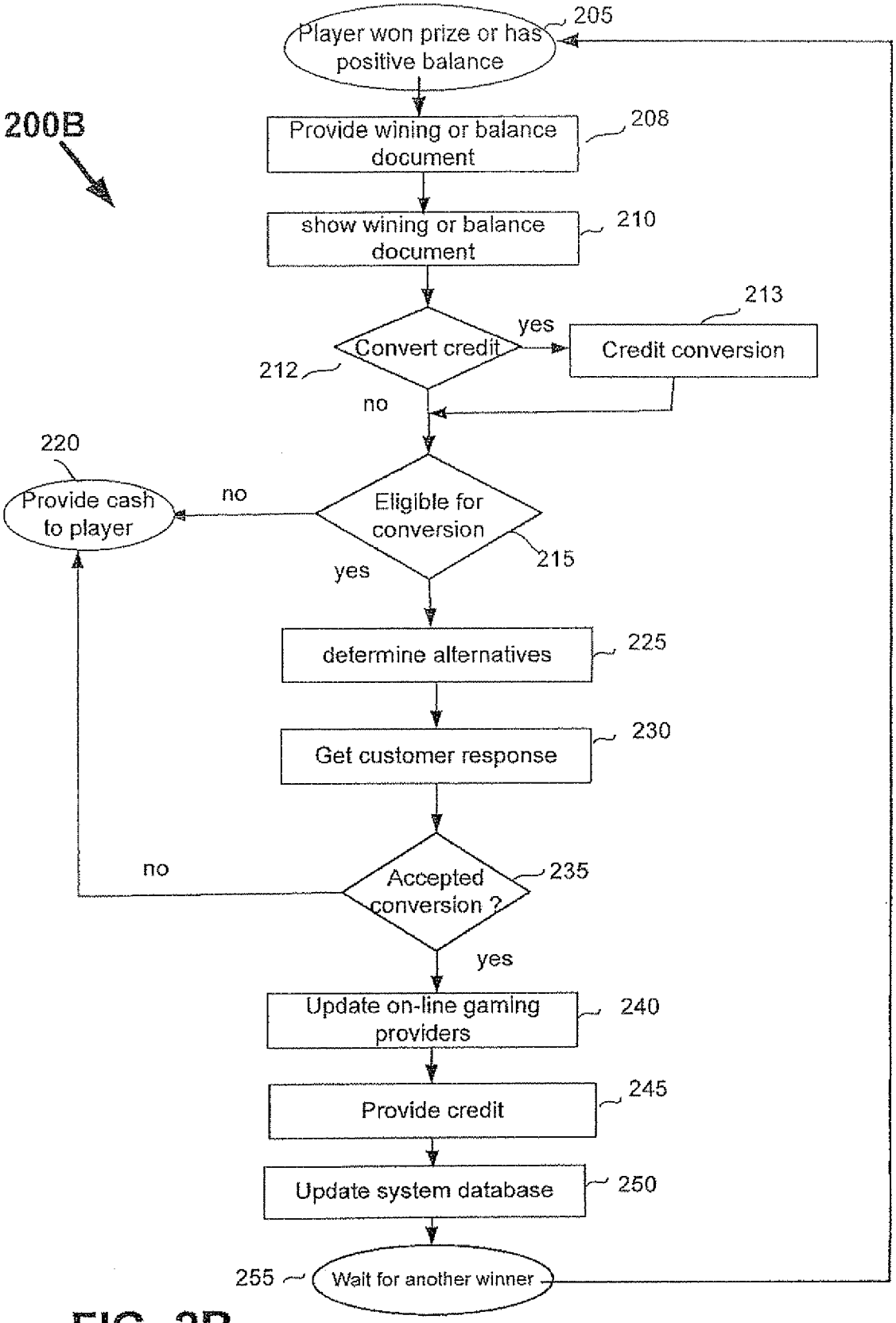
FIG. 2B is a flow chart illustrating the detailed steps performed by a system for converting a land based gaming machine coupons to on-line gaming credit, according to an exemplary embodiment of the method.

FIG. 2B is a flow chart, generally referenced 200B that describes the detailed steps for implementing a method and system for using a landbased gaming machine coupons on I/T based gaming devices.

On initial step 205 a player plays on a land based gaming machine and wins an amount of money, or finishes to play while having a positive credit balance. On step 208 the player gets a wining document or a balance indication and on step 210 provides it to either a person in charge or to an automatic device.

In an exemplary embodiment of the method, on step 212 the system checks for a balance indication. If the player shows a balance indication the system optionally performs a credit conversion (213) where it replaces the balance indication with online gaming credit and provides the player with a credit indication.

In an exemplary embodiment of the method, on step 215, whether the system replaced the player's balance indication with a credit document or not, the system performs preliminary checks to verify that the player is eligible for getting an offer for converting the prize or part thereof to credit for further use with on-line gaming sites.

Such preliminary checks may take into account the player's age, historical records associated with the player, or other data. In an exemplary embodiment of the method a player may not be eligible for converting a landbased winning document to an on-line gaming credit if he or she is not at least eighteen years old. It should be noted that such preliminary checks are optional and may alternatively be skipped by a system according to the present method.

In case that the player is not found eligible for getting an offer for converting the prize or part thereof to credit for further use with online gaming sites, on step 220 the system will provide the player with an amount of money according to the wining document.

If the player is found eligible for getting on-line credit, on step 225 the system determines one or more alternatives of on-line credit and provides the player with the results.

On step 230 the system receives and intercepts the player's choice.

If the player chose to accept an offer to convert his prize or part thereof to on-line credit, on step 240 the system updates the on-line gaming providers which were included in the accepted offer with the chosen offer. For example if the accepted offer included a forty dollars credit in on-line gaming site X and a thirty dollars credit in online gaining site Y—the system has to update on-line gaming sites X and Y that the player identified by the code 3HGF5rd has to get a forty dollars credit with on-line gaming site X and the player identified by the code KJ456SAwe has to get a thirty dollars credit with on-line gaming site Y. When the player will later connect to any of the on-line gaining sites X or Y the these codes (3HGF5rd, KJ456SAwe respectively) should approve the player as having on-line gaming credit valid for use in these on-line gaming sites.

On step 240 the player's details, including for example identification details, funds, balance, credit or the like are transferred from the server to one or more sites or on-line gaming providers such as 155. The transfer is preferably performed by a dedicated component such as a software component accessed through Application Program Interfaces (API) as described in association with step 271 above.

In an exemplary embodiment of the method, this step may include an additional step when the system requests the on-line gaining sites to provide a code which is also provided to the player. In another exemplary embodiment of the method, the system reserves a stock of predefined codes for future distribution and thus this additional step is omitted.

If the player does not choose any of on-lint credit offers, on step 235 the system will provide the player with the cash or credit the player's account with the amount according to the wining document.

If the player chooses an offer that includes on-line credit, on step 245 the system will provide the player with the cash money amount, if such cash amount was included in the chosen offer and will also provide the player with credit indication according to the accepted offer.

On step 250 the system optionally memorizes the offer details, for example by updating a database for purposes such as future determination of alternative offers, taking into account the specific player history. On step 255 the systems returns to a waiting state in which it waits for another wining player.

While the steps described in FIG. 2B were presented in a specific order, the procedure of converting the player's balance indication and converting the player's wining document are interchangeable.

It should be appreciated that the above described methods and systems may be varied in many ways, including omitting or adding steps, changing the order of steps and the type of devices used. It should be appreciated that different features may be combined in different ways. In particular, not all the features shown above in a particular embodiment are necessary in every embodiment of the invention. Further combinations of the above features are also considered to be within the scope of some embodiments of the invention.

It will be appreciated by persons skilled in the art that the present methods and apparatus are not limited to what has been particularly shown and described hereinabove. Rather the scope of the present invention is defined only by the claims, which follow.

The invention claimed is:

1. A method of operating a computerized gaming system operable in a landbased gaming mode controlled by at least one landbased gaming control unit and in an on-line gaming mode controlled by at least one on-line gaming control unit, the method comprising:

(a) identifying a player by the at least one landbased gaming control unit;

(b) obtaining by the at least one landbased gaming control unit an information related to said player, said information indicative, at least, of said player's balance with regard to the landbased gaming mode;

(c) responsive to said player's switching from the landbased gaming mode to on-line gaming mode, electronically communicating the most updated information indicative, at least, of said player's balance with regard to the landbased gaming mode from the at least one landbased control unit controlling the landbased gaming mode directly to the at least one on-line control unit controlling the on-line gaming mode, thereby enabling said player to participate in the on-line playing mode, wherein the at least one on-line control unit operates independently of the at least one landbased gaming control unit.

2. The method of claim 1 further comprising updating the at least one landbased control unit controlling the landbased gaming mode and the at least one on-line control unit controlling the on-line gaming mode upon finishing the game in one of the modes.

3. The method of claim 1 wherein the landbased gaming mode and the on-line gaming mode is controlled by at least two different operators.

4. The method of claim 1 wherein the switching between gaming modes is provided without additional identifying the player.

5. The method of claim 1 further comprising, when switching from landbased gaming mode to on-line gaming mode, automated obtaining one or more codes to be used by the player for on-line gaming mode.

6. The method of claim 1 further comprising automatically converting respective landbased balance indication into on-line credit, thereby enabling switching from landbased gaming mode to on-line gaming mode.

7. The method of claim 6 wherein the landbased balance indication is converted into a plurality of on-line credits divided, respectively, between a plurality of on-line gaming sessions.

8. A computerized gaming module operable in a landbased gaming mode and operatively connectable to one or more on-line gaming modules operable in on-line gaming mode, the module comprising:

(a) means for identifying a player;

(b) means for obtaining an information related to said player, said information indicative, at least, of said player's balance with regard to the landbased gaming mode;

(c) one or more landbased control units adapted to control the landbased gaming mode and operable, responsive to said player's switching from the landbased gaming mode to on-line gaming mode, electronically communicate the most updated information indicative, at least, of said player's balance directly to one or more on-line control units operating independently of said one or more landbased control units and adapted to control the on-line gaming mode.

9. The module of claim 8 wherein said one or more landbased control units are further operable to obtain updated information from said one or more on-line control units, said updated information indicative, at least, of said player's balance with regard to the on-line gaming mode.

10. The module of claim 8 wherein said one or more landbased control units are further operable to obtain from said one or more on-line control units one or more codes, and wherein the on-line gaming module further comprises means to provide said obtained codes to the player.

11. The module of claim 8 further comprising means for automatically converting respective landbased balance into on-line credit, said on-line credit to be communicated to said one or more on-line gaming modules.

12. The module of claim 11 wherein the landbased balance is converted into a plurality of on-line credits, each one to be communicated to respective on-line gaming module.

13. A computer program product comprising a non-transitory computer-readable medium storing computer reading program code that causes, when run on a computer, a computerized game system to:

(a) identify a player by at least one landbased gaming control unit;

(b) obtain by the at least one landbased gaming control unit an information related to said player, said information indicative, at least of said player's balance with regard to a landbased gaming mode;

(c) responsive to said player's switching from the landbased gaming mode to on-line gaming mode, electronically communicating the most updated information indicative, at least, of said player's balance with regard to the landbased gaming mode directly to at least one on-line control unit controlling the on-line gaming mode, thereby enabling said player to participate in the on-line playing mode, wherein the at least one on-line control unit operates independently of the at least one landbased gaming control unit.

* * * * *